US005794555A

United States Patent [19]

Kwang

[11] Patent Number: 5,794,555

[45] Date of Patent: Aug. 18, 1998

[54] PROCESS FOR PROVIDING AN ARTICLE WITH A MACHINE-MADE EMBROIDERY PATTERN IN RELIEF

[75] Inventor: Ricky Pang Kim Kwang, Singapore, Singapore

[73] Assignee: Madeira Asia Pte. Ltd., Singapore, Singapore

[21] Appl. No.: 908,448

[22] Filed: Aug. 7, 1997

[30] Foreign Application Priority Data

Aug. 8, 1996 [DE] Germany ..... 196 32 092.5

[51] Int. Cl.[6] ..... D05C 17/00

[52] U.S. Cl. ..... 112/475.22

[58] Field of Search ..... 112/475.18, 475.23, 112/475.22, 439; 156/91, 92, 93, 155; 128/104, 187; 2/244, 246

[56] References Cited

U.S. PATENT DOCUMENTS

| | | | |
|---|---|---|---|
| 889,614 | 6/1908 | Johnsen | 112/439 X |
| 1,171,154 | 2/1916 | Stern | 112/439 X |
| 3,771,479 | 11/1973 | Mavis | 112/439 X |
| 4,140,563 | 2/1979 | Sernaker | 112/475.18 X |
| 5,421,919 | 6/1995 | Lagreca | 112/475.23 X |
| 5,609,119 | 3/1997 | Yeh | 112/475.23 |

*Primary Examiner*—Ismael Izaguirre
*Attorney, Agent, or Firm*—Henry M. Feiereisen

[57] ABSTRACT

A process for providing an article with a machine-made embroidery pattern in relief, includes the steps of placing a base material of paper and cardboard upon the article, embroidering an embroidery pattern on the base material and the article, and removing the base material in a water bath while subjecting the water bath to ultrasound.

6 Claims, 3 Drawing Sheets

PROCESS FOR PROVIDING AN ARTICLE WITH A MACHINE-MADE EMBROIDERY PATTERN IN RELIEF

BACKGROUND OF THE INVENTION

The present invention refers to a process for providing an article with a machine-made embroidery pattern in relief, and more specifically to a process of embroidering an article in relief by applying a base material upon the article prior to embroidery.

It is generally known to provide articles of textile fabric, cloth, leather, plastics or the like with a machine-made embroidery design. Typically, the embroidered design is only slightly raised above the article surface so that embroidery in relief is utilized in those cases which require the design to prominently stand out from the article surface.

An embroidery pattern in prominent relief with regard to the plane of the article is conventionally made by applying a flat base material of suitable thickness, e.g. a thin foamed material, on the article before being embroidered. During subsequent embroidery, the sequence of stitches (either during embroidery or during a last stitching cycle without embroidering yarn) is so narrowly selected at least along the outline of the design that the base material projecting beyond the outline of the design can subsequently easily be separated as a consequence of the intense perforation. This conventional process for creating an embroidery in relief is however time-consuming, especially when producing complex designs with numerous contours because the overlying base material must be manually removed and results in a generation of small and smallest fragments. In the event of a series production of such embroideries in relief, great quantities of such fragments can accumulate which in addition pose a problem as far as disposal is concerned.

SUMMARY OF THE INVENTION

It is thus an object of the present invention to provide an improved process for providing an article with a machine-made embroidery pattern in relief, obviating the afore-stated drawbacks.

In particular, it is an object of the present invention to provide an improved process for providing an article with a machine-made embroidery pattern in relief, which process is time saving and more cost-efficient compared to conventional processes.

These objects and others which will become apparent hereinafter are attained in accordance with the present invention by placing a base material of paper and cardboard upon the article, embroidering embroidery patterns on the base material and the article, and removing the base material from the article by flushing in a water bath while subjecting the water bath to ultrasound.

In the process according to the present invention, the time-consuming and thus expensive step of manually removing the base material is eliminated so that it is now possible to create almost any complex design containing numerous small design elements which are conspicuously raised in relief through embroidery. Unlike conventional processes in which the base material, typically foamed material, remains underneath the embroidery pattern in relief and during the course of use of the article decomposes, e.g. during washing or dry cleaning, so as to stain in the form of small particles the scouring bath or even the article, the process according to the present invention results in a complete removal of base material from underneath the finished embroidery.

Dissolution of the base material can be enhanced by heating the water bath and/or setting the water bath in motion. A further acceleration of dissolution and removal of the base material can be effected by using a heated ultrasonic cleaning bath.

As solvent, water is preferably used as its is cheap and poses no problems so long as the base material is water-soluble or dispersible in water. Preferably, the base material is made of paper or cardboard which are cheap and available in all thicknesses and moreover can be dispersed or suspended in the solvent and easily be disposed of. Preferably, rice paper is used as material for the base material because rice paper is particularly light and rapidly dissolves in the water bath.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
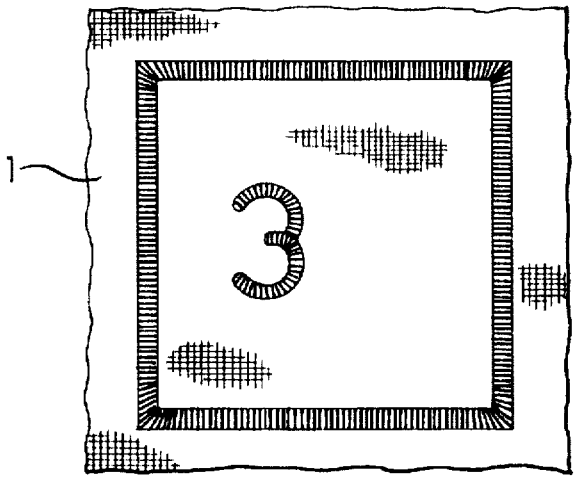
FIG. 1 is a plan view of an exemplified fabric embroidered with an embroidery pattern in a conventional manner.

Throughout all the Figures, the same or corresponding elements are generally indicated by the same reference numerals.

Figure 2:
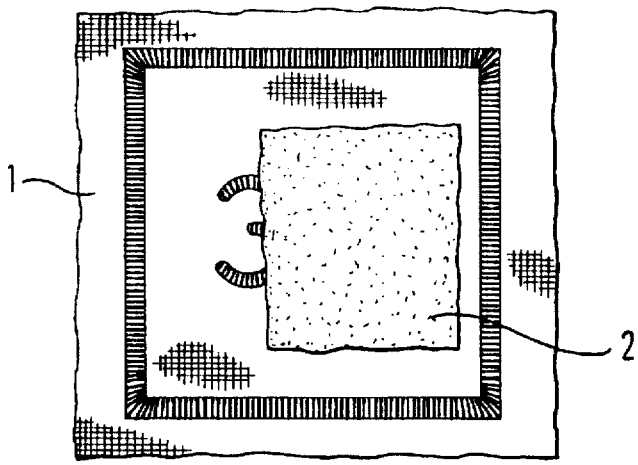
FIG. 2 is a plan view of the fabric of FIG. 1, with a base material being placed on the fabric and partially covering the design.

Turning now to the drawing, and in particular to FIG. 1, there is shown a plan view of an exemplified article in the form of a stitchable fabric 1 onto which a design in the form of a square frame and the number "3" is embroidered in plain stitches by a machine in a conventional manner. In order to supplement this design with a letter "D" that is embroidered in relief, a base material 2 is placed over a respective region of the fabric 1, as shown in FIG. 2. The base material 2 may be made of paper or cardboard, preferably rice paper. Normally, the base material 2 is composed of several layers of material sheets in order to provide the embroidery in desired relief. In conjunction with rice paper, tests have shown that up to thirty sheets of rice paper can be utilized in order to raise the embroidery pattern, e.g. by about 1 mm, conspicuously from the surface of the article. Other base materials are handled in an analogous fashion.

Subsequently, the letter "D" is embroidered at the intended location. The embroidery technique is generally known. Normally, the upper thread is employed at reduced tension. Conventional embroidering machines then enable the production of raised designs of up to about one millimeter.

Figure 3:
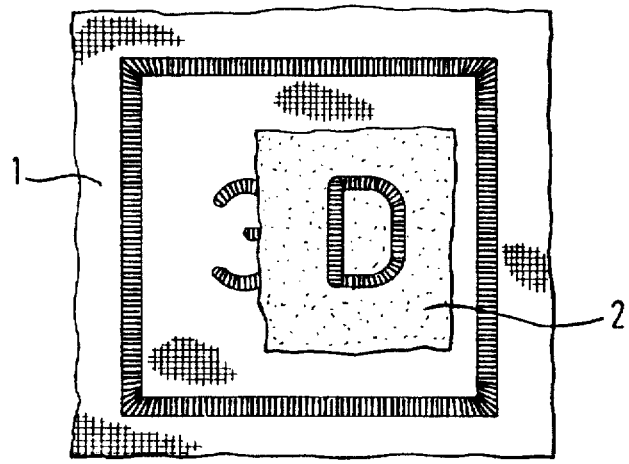
FIG. 3 is a plan view of the fabric after being embroidered with an embroidery pattern in the form of the letter "D" in the region of the base material.
Figure 4:
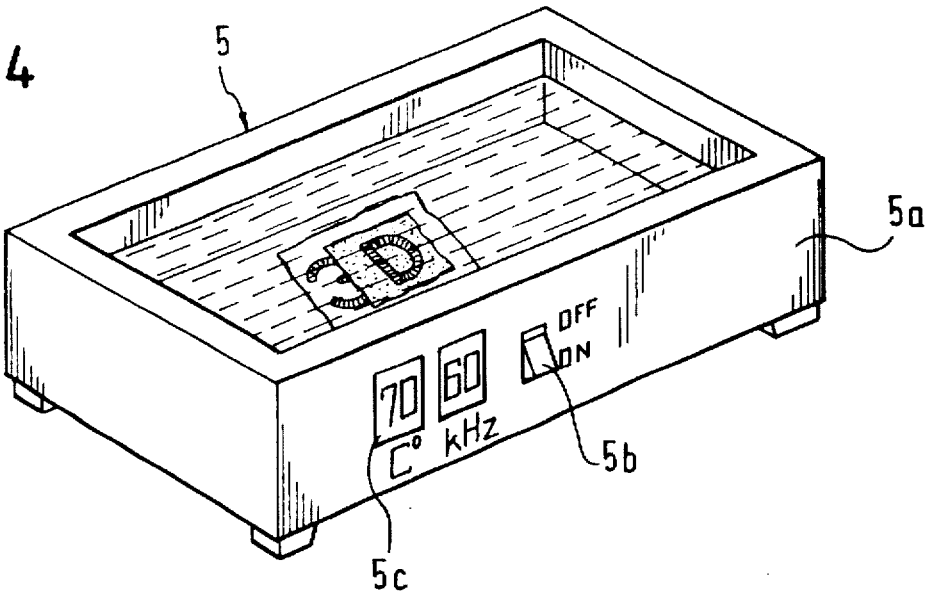
FIG. 4 is a perspective illustration of an ultrasonic bath for receiving the fabric of FIG. 3.
Figure 8:
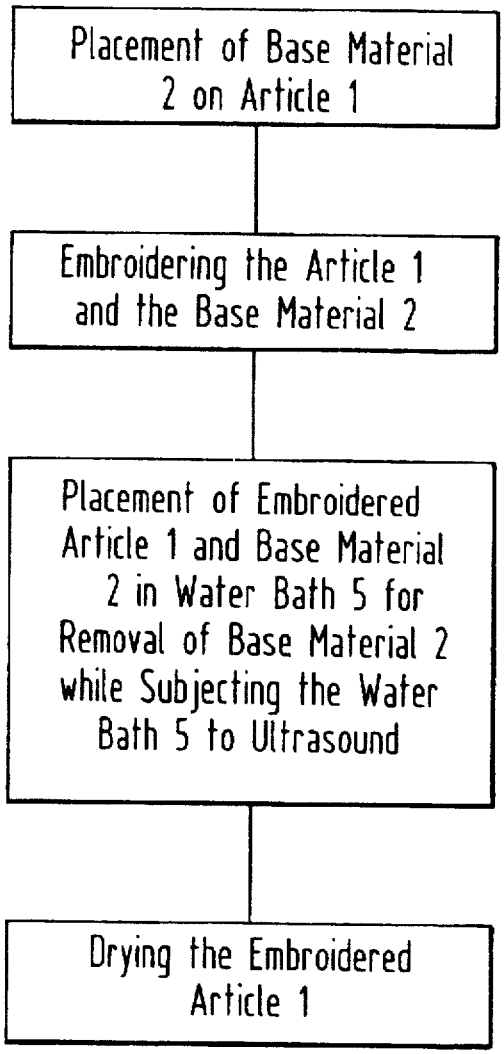
FIG. 8 is a general flow diagram of a process for making an article with an embroidery pattern in relief in accordance with the present invention.

The article, i.e. the fabric 1, embroidered as shown in FIG. 3, is then placed in a water bath, shown in FIG. 4 and generally designated by reference numeral 5. The water bath 5 is formed by a tray 5*a* which contains water as solvent and has an on/off control switch 5*b* as well as displays 5*c* for temperature and frequency data. After placing the fabric 1 in the water bath 5, water dissolves the base material 2 whereby the dissolving process is further enhanced by subjecting the water bath 5 to ultrasound. Suitably, the temperature of the water bath 5 may be increased, e.g. to 70° C., and the solvent may be set in motion to further enhance the dissolution and removal process of the base material 2 from the fabric 1. The fabric 1 remains in the water bath 5 until the base material 2 is completely dissolved and in suspension. The temperature of the water bath 5 depends on the temperature stability of the fabric 1, and the proper duration of the treatment period can be determined by tests and should last at least until the base material 2, e.g. rice paper, has been completely removed from the fabric 1. Subsequently, the fabric 1 is dried, e.g. spin-dried and then air-dried. FIG. 8 shows a general flow diagram of the process for making an article with an embroidery pattern in relief in accordance with the present invention.

It will be appreciated by persons skilled in the art that in the event of operating a closed-loop solvent circulation, also solvents other than water may be applicable, such as liquid hydrocarbons, so long as the base material is dissolvable therein.

Figure 5:
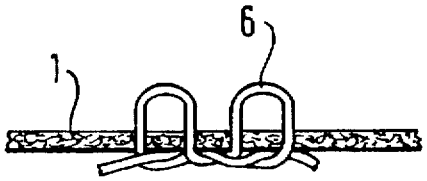
FIG. 5 is a partially sectional, simplified side view, on a greatly enlarged scale, of the fabric in an area of the embroidery in relief.

Persons skilled in the art will also understand that the article need not necessarily be made of fabric. Rather all carrier materials that are suitable for embroidering can be utilized. The only discriminating fact is the determination whether the article is stitchable, or whether the strength of the carrier material is insufficient to permit embroidering. In the first case, the article can be directly embroidered, as shown in FIG. 5, resulting in the illustrated loop pattern. In the area of the embroidery pattern in relief, the upper thread forms the "raised" loops 6.

Figure 6:
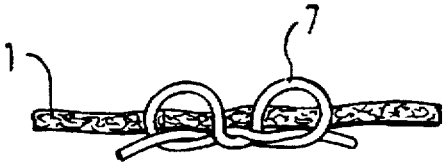
FIG. 6 is a partially sectional side view of a non-stitchable fabric prior to creation of the embroidery in relief.
Figure 7:
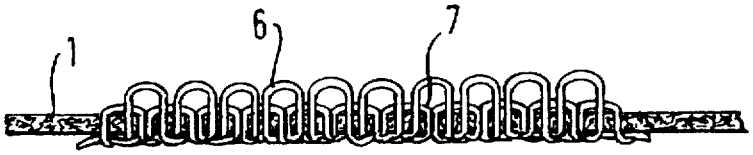
FIG. 7 is a partially sectional side view of the fabric of FIG. 6 after embroidery in relief.

In the event the article is non-stitchable, e.g. a carrier material made of very thin and/or soft fabric, the zone to be embroidered is first stiffened through embroidery of the entire zone, e.g. by a so-called tatami stitch 7, as shown schematically in FIG. 6. Subsequently, the embroidery pattern in relief is applied in a manner shown in FIGS. 2–4 and 8, with FIG. 7 illustrating schematically the loop pattern with tatami stitches 7 and the raised loops 6 of the relief embroidery.

While the invention has been illustrated and described as embodied in a process for providing an article with a machine-made embroidery pattern in relief, it is not intended to be limited to the details shown since various modifications and structural changes may be made without departing in any way from the spirit of the present invention.

What is claimed as new and desired to be protected by letters patent is set forth in the appended claims:

What is claimed is:

1. A process for providing an article with a machine-made embroidery pattern in relief, comprising the steps of:

placing a base material of a material selected from the group consisting of paper and cardboard upon an article;

embroidering an embroidery pattern on the base material and the article; and removing the base material from the article in a water bath while subjecting the water bath to ultrasound.

2. The process of claim 1 wherein said removing step includes heating the water bath.

3. The process of claim 1 wherein said removing step includes setting the water bath in motion.

4. The process of claim 1 wherein said removing step includes heating the water bath and setting the water bath in motion.

5. The process of claim 1 wherein said removing step is executed in a heatable ultrasonic cleaning bath.

6. The process of claim 1 wherein the base material is made of rice paper.

* * * * *